US007931320B2

(12) United States Patent
Alway et al.

(10) Patent No.: US 7,931,320 B2
(45) Date of Patent: Apr. 26, 2011

(54) SELF-ADJUSTING LOAD BAR

(75) Inventors: Vern J. Alway, Lake Sherwood, MO (US); Michael L. Timmer, Wright City, MO (US)

(73) Assignee: Innovation Egineering, Inc., St. Louis, MO (US)

( * ) Notice: Subject to any disclaimer, the term of this patent is extended or adjusted under 35 U.S.C. 154(b) by 657 days.

(21) Appl. No.: 11/947,559

(22) Filed: Nov. 29, 2007

(65) Prior Publication Data

US 2008/0129065 A1 Jun. 5, 2008

Related U.S. Application Data

(60) Provisional application No. 60/861,820, filed on Nov. 30, 2006.

(51) Int. Cl.
*B66C 1/10* (2006.01)

(52) U.S. Cl. ..... 294/81.3; 294/81.4; 294/67.5; 414/561

(58) Field of Classification Search ..... 74/490.09; 414/561; 294/81.3, 81.4, 67.21, 67.5, 907
See application file for complete search history.

(56) References Cited

U.S. PATENT DOCUMENTS

| | | | | |
|---|---|---|---|---|
| 3,596,968 | A | 8/1971 | Holm | |
| 4,422,683 | A * | 12/1983 | Charonnat | 294/81.3 |
| 4,461,455 | A * | 7/1984 | Mills et al. | 254/3 R |
| 4,597,602 | A * | 7/1986 | McGriff | 294/81.3 |
| 4,671,721 | A | 6/1987 | Pratt et al. | |
| 4,831,967 | A | 5/1989 | Anderson | |
| 4,936,616 | A | 6/1990 | Williams | |
| 4,973,094 | A | 11/1990 | Tana et al. | |
| 5,205,544 | A | 4/1993 | Kroeger | |
| 5,279,178 | A * | 1/1994 | Yanagisawa | 74/490.09 |
| 5,280,981 | A * | 1/1994 | Schulz | 294/106 |
| 5,311,791 | A * | 5/1994 | Yanagisawa | 74/490.09 |
| 6,722,635 | B2 * | 4/2004 | Erickson | 254/103 |
| 2008/0131248 | A1 * | 6/2008 | Friz et al. | 414/561 |

* cited by examiner

*Primary Examiner* — Dean J Kramer
(74) *Attorney, Agent, or Firm* — Armstrong Teasdale LLP

(57) ABSTRACT

A method is provided for assembling a load bar assembly. The method includes providing a first linear stage having a first alignment mechanism that is configured to move the load bar assembly in a first direction. A second linear stage is provided that includes a second alignment mechanism that is configured to move the load bar in a second direction that is different from the first direction. The first alignment mechanism is positioned with respect to the second alignment mechanism such that the first alignment mechanism and the second alignment mechanism are prevented from being back-driven. The first alignment mechanism and the second alignment mechanism are configured to lock if one of the first alignment mechanism and the second alignment mechanism fails.

17 Claims, 5 Drawing Sheets

SELF-ADJUSTING LOAD BAR

CROSS REFERENCE TO RELATED APPLICATIONS

This application claims the benefit of Provisional Patent Application No. 60/861,820 filed Nov. 30, 2006.

BACKGROUND OF THE INVENTION

The invention relates to lifting fixtures used to precisely control the attitude of loads being handled by overhead cranes.

In many aerospace and related industries, the loads being lifted by cranes are expensive, delicate, and require precise manipulation at many stages in the manufacturing process. This problem has been solved in the past by the design and construction of a large array of special fixtures or adapters each of which permit a single type load to be lifted. It is desirable from a cost and schedule standpoint to have a more universal solution. Specifically, it is desirable to have a single device that adapts itself to a larger number of load types.

In lifting any load with an overhead crane, stability requires that the center of gravity of the load has to be directly below the hook. An automatic system must move the load in two dimensions relative to the hook so that a stable lift is possible. However, an automated system, especially one that is lifting heavy items, could easily injure personnel and damage equipment if a malfunction occurred. Of particular concern would be a "runaway" drive element, which would swing the load. Moreover, an ease of use is important to efficient manufacturing operations and computerized control is the current state of the art way to achieve such ease of use.

The present invention increases the reliability of a self-adjusting load bar by means of a safety architecture that facilitates preventing a "runaway" malfunction without compromising the ease of use.

BRIEF DESCRIPTION OF THE INVENTION

In one aspect, a method is provided for assembling a load bar assembly. The method includes providing a first linear stage having a first alignment mechanism that is configured to move the load bar assembly in a first direction. A second linear stage is provided that includes a second alignment mechanism that is configured to move the load bar in a second direction that is different from the first direction. The first alignment mechanism is positioned with respect to the second alignment mechanism such that the first alignment mechanism and the second alignment mechanism are prevented from being back-driven. The first alignment mechanism and the second alignment mechanism are configured to lock if one of the first alignment mechanism and the second alignment mechanism fails.

In another aspect, a frame is provided for use with a load bar assembly. The frame includes a first alignment mechanism that is configured to move the frame in a first direction, and a second alignment mechanism that is configured to move the frame in a second direction that is different from the first direction. The first alignment mechanism is positioned with respect to the second alignment mechanism such that the first alignment mechanism and the second alignment mechanism are prevented from being back-driven. The first alignment mechanism and the second alignment mechanism are configured to lock if one of the first alignment mechanism and the second alignment mechanism fails.

In a further aspect, a load bar assembly is provided that includes a first linear stage including a first alignment screw that is configured to move the load bar assembly in a first direction. A second linear stage is provided that includes a second alignment screw that is configured to move the load bar in a second direction that is different from the first direction. The first alignment screw is positioned with respect to the second alignment screw such that the first alignment screw and the second alignment screw are prevented from being back-driven. The first alignment screw and the second alignment screw are configured to lock if one of the first alignment screw and the second alignment screw fails.

DETAILED DESCRIPTION OF THE INVENTION

The load bar assembly described herein includes an X linear stage held by an overhead crane hook, and stacked on a Y direction linear stage that holds the load. Each linear stage contains dual-redundant motor drives with separate motors and controllers. Because the gear ratio of the linear screws is such that they cannot be back driven, the linear screws will lock mechanically if one of the drives fails. In addition, the screws will lock if the two drives are not synchronized. This prevents a motor/controller runaway from being able to move the device. Automatic leveling is achieved by the use of three redundant two-axis tilt sensors that provide input to motion control computers. Further, safety is enhanced by the inclusion of a deadman switch. Motor operation is not permitted unless this deadman switch is held closed by the operator.

Figure 1:
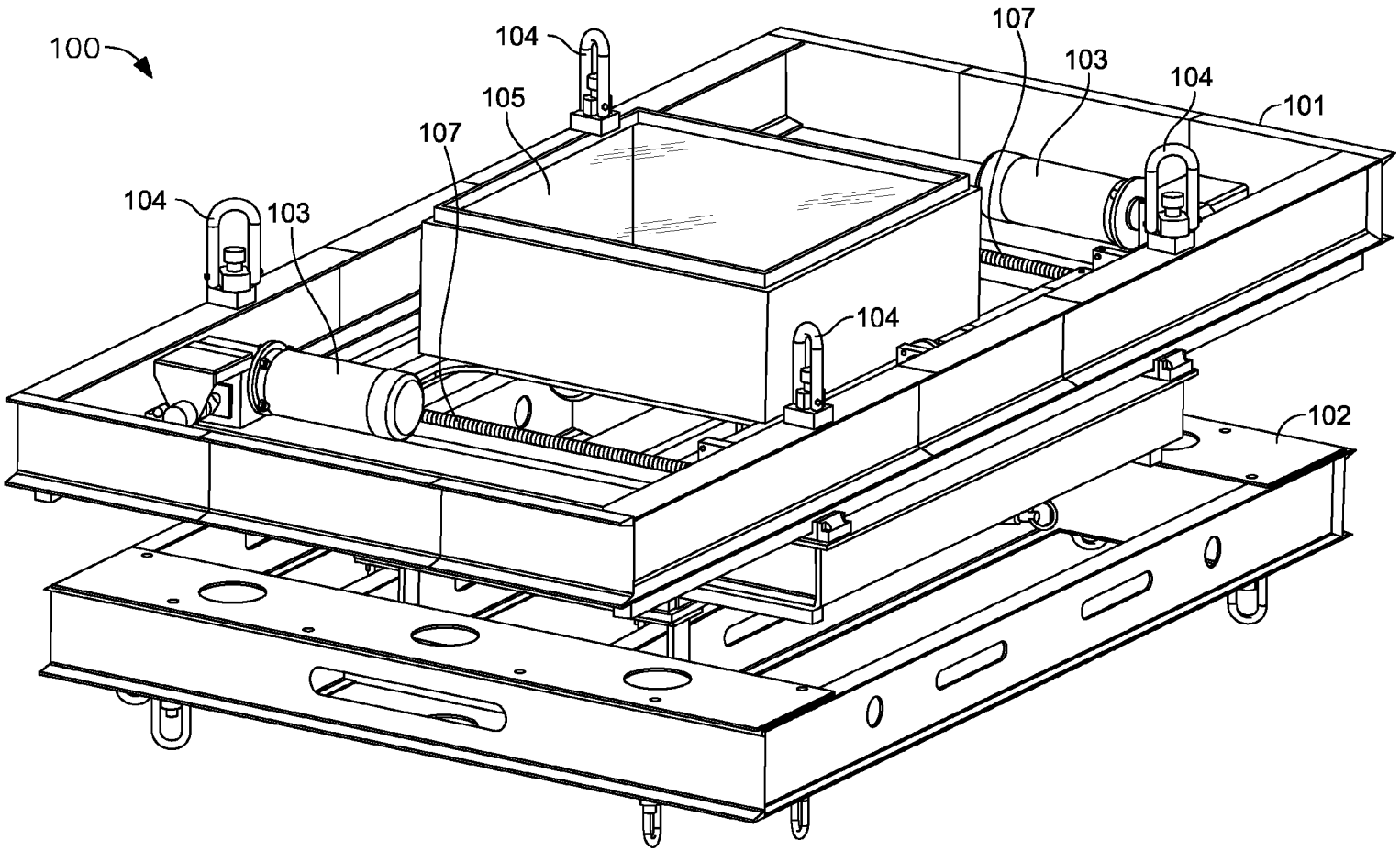
FIG. 1 is a schematic of an exemplary self-adjusting load bar.
Figure 7:
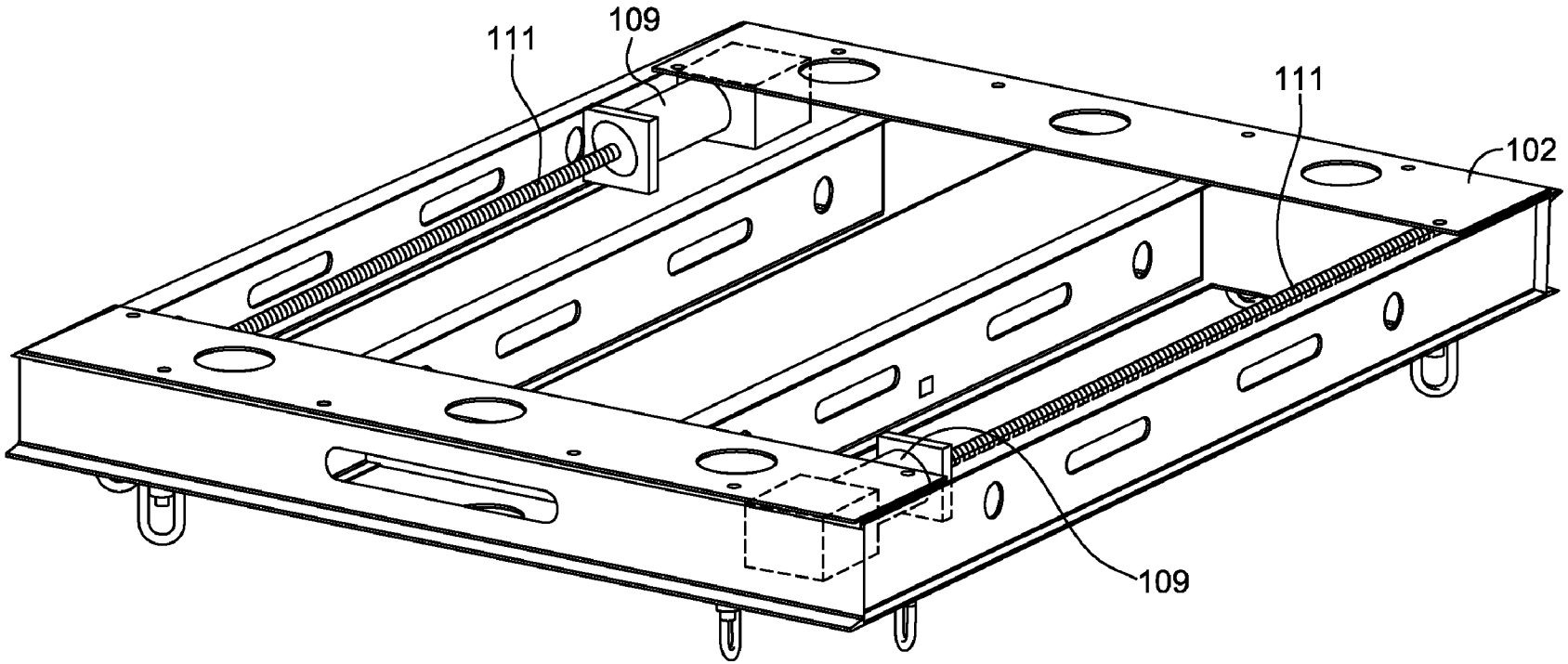
FIG. 7 is a schematic of the self-adjusting load bar of FIG. 1 with a portion thereof removed.

FIG. 1 is a view of a self-adjusting load bar mechanism 100. An X frame 101 connects to the hook of the overhead crane using a four-way sling with through eye bolts 104. The X drive is operated by two motors 103 that each turn a ball bearing screw 107. When the motors are turned synchronously, a Y frame 102 is moved back and forth along rails. Similarly, the Y frame 102 is driven in the orthogonal direction by two Y motors 109 that each turn a ball bearing screw 111. Y frame 102 is shown in additional detail in FIG. 7, including Y motors 109 and ball bearing screw 111. The load is attached by means of eye bolts 104 on the bottom of the assembly. In the exemplary embodiment, controls and battery power for the self-adjusting load bar mechanism are contained in an electronic enclosure 105.

The sizing and strength of the mechanical components is important to the safety of load bar 100. Accordingly, in the exemplary embodiment, a single linear X drive is configured to support the load completely in the event of a failure of another X drive. As such, even if one of the two drives fails in a "runaway" mode, the screw on the other side will restrain it.

Synchronization of the two X servo systems must be achieved to allow the unit to operate in the X-direction.

The dual Y drive is mechanically designed to have the same safety factor. Accordingly, a single linear Y drive can hold an entire load. Further, synchronization of the two Y servo systems must be achieved to allow the unit to move in the Y-direction.

In the exemplary embodiment, the load bar controls include at least two motion controllers. Each controller includes an X and Y absolute position encoder, a two axis tilt sensor, a two channel DC switching amplifier, an X DC motor, and Y DC motor. The X and Y DC motors are capable of handling the full load. The controls also include an additional controller 205 that acts as a safety arbitrator and operates an E-stop. The additional motor includes an X and Y absolute position sensor and a two axis tilt sensor.

Figure 2:
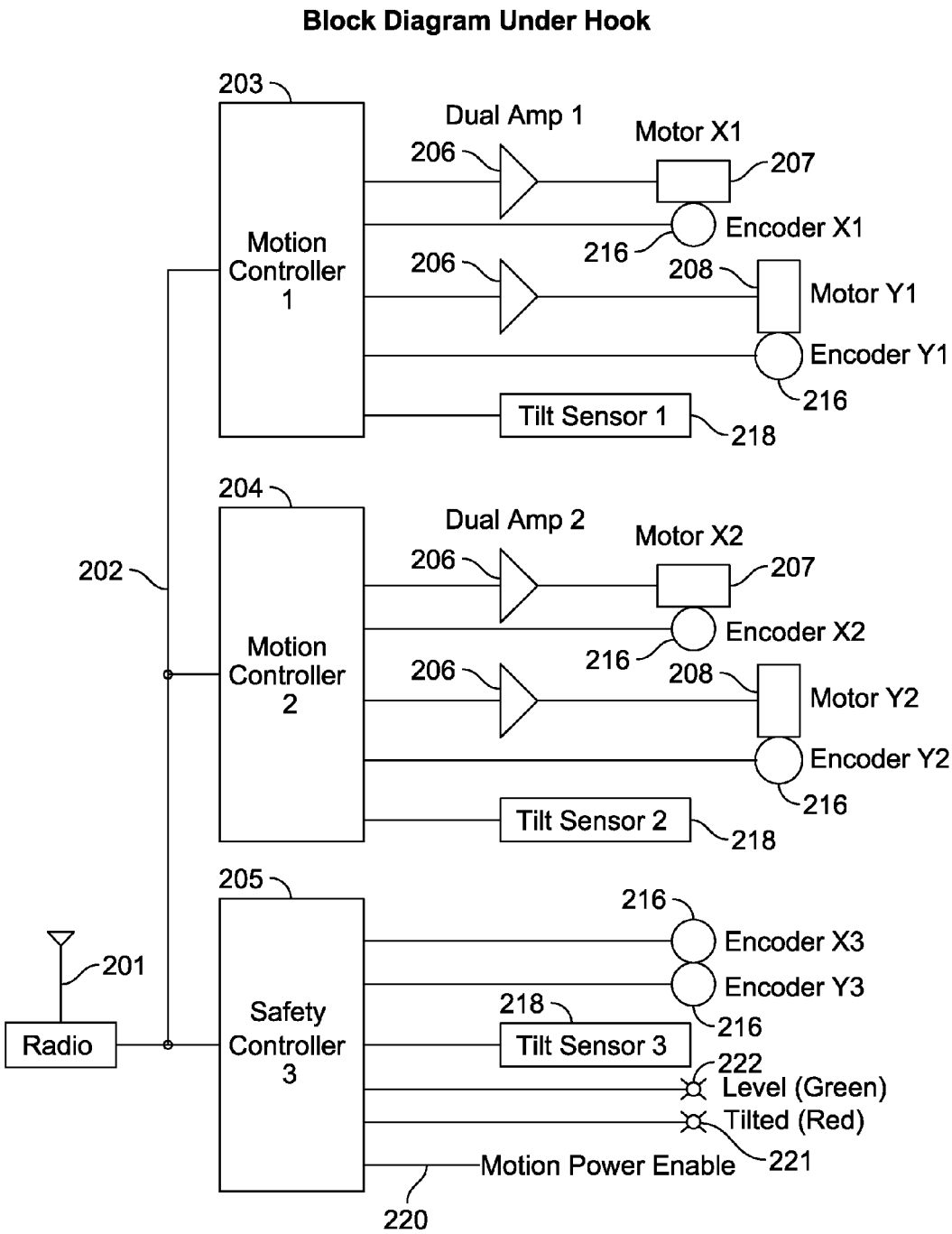
FIG. 2 is a block diagram of an under hook that may be used with the self-adjusting load-bar show in FIG. 1.

FIG. 2 is a block diagram of an under the hook control system. Control messages are received via an on-board radio 201. These control messages are transmitted on a communications bus 202 that allows three on board controllers 203, 204, and 205 to communicate with each other and via radio to the ground control system (shown in FIG. 3). Functionality is divided between the controls components so that a "runaway" failure cannot occur on any single point of failure. Thus, if computer 203 or any of its collection of peripheral elements (dual amplifier 206, motors 207/208, encoders 216, and/or tilt sensors 218) fail, only half of each stage will be impacted. With the other half working normally the system will mechanically lock in a fail-safe manner. By symmetry the same fail-safe operation is realized if computer 204 or any of its peripheral devices fail.

To further enhance safety, a third computer 205 is added. This computer has its own set of sensors to enable it to check the motion control computers. Computer 205 executes continuous safety checks and turns motion power off if a position, tilt, and/or communications discrepancy is detected. In addition, this computer operates red 221 and green 222 lights used by the overhead crane operator to guide his lift. The red light indicates "out of level" and the green light indicates "level". Specifically, red light 221 indicates that the load bar is outside a preset level of tolerance, and green light 222 indicates that the load bar is within the preset level of tolerance. The overhead crane operator stops his winch if the red light illuminates and gives the load bar a longer time to automatically level. When the green light illuminates, the load bar is at its tilt set-point plus or minus the operational angular tolerance selected. An additional safety feature of the invention is that the motion power enable signal 220 must be alternated on and off to keep the power on the motors. A failure in either state will open a hardware watch-dog relay, causing the machine to stop. Further, red light/green light 221/222 is visible to at least one of ground personnel and bridge crane personnel. Moreover, red light/green light 221/222 flashes when the motors are deactivated, for example when a deadman switch is released.

Figure 3:
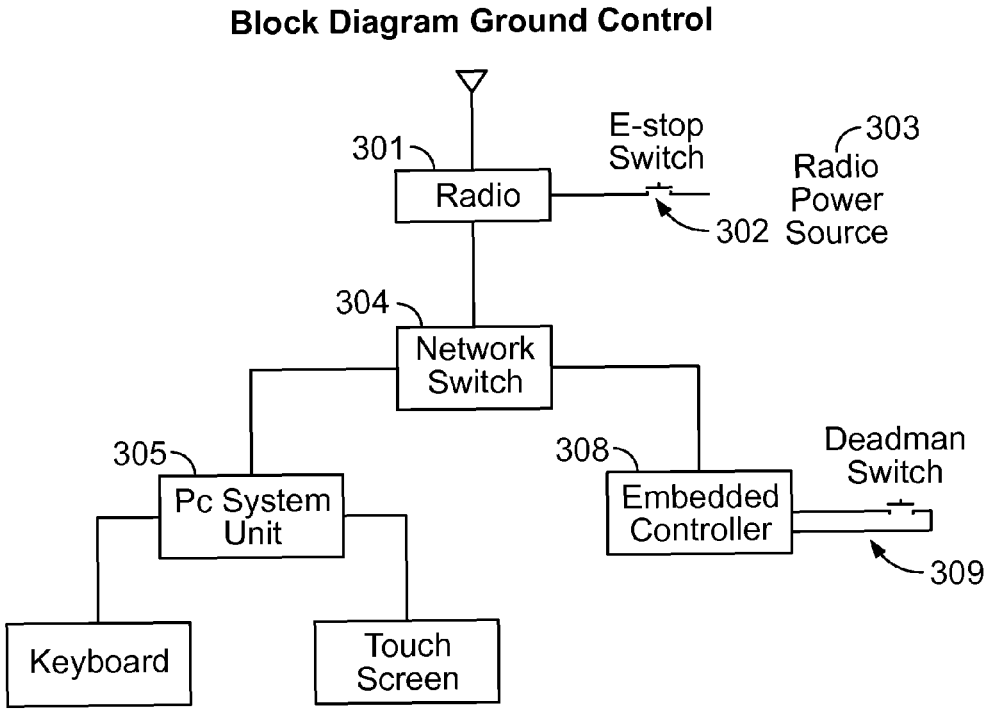
FIG. 3 is a block diagram of a ground control that may be used with the self-adjusting load-bar show in FIG. 1.

A ground control unit is provided for use by the ground operator responsible for moving the load. This unit is mounted on a mobile cart or in a self-contained operator pendant so that it can be available at the pickup and delivery points of the overhead crane. FIG. 3 is a block diagram of the ground unit. It includes a radio transceiver 301 for communications with the under the hook equipment of FIG. 2. The power 303 for this radio can be removed by pressing an E-stop button 302. E-stop 302 is controlled by an independent computer with its own independent set of sensors. The resulting loss of communications will be sensed by the load bar that will then remove power from the drive motors. The mobile cart includes a PC system unit, an LCD color touch screen, a keyboard used for set-up functions with alpha characters, an e-stop button, a deadman switch, a digital radio, a power supply, a power switch, and a line cord. In the exemplary embodiment the line cord is 30 feet long. A battery back-up is used to eliminate the cord in cases where more mobility is required.

A network switch 304 connects an embedded controller 308 and a personal computer system unit 305 to the radio. The purpose of the embedded controller is to provide a reliable path for the deadman switch 309 to respond to messages from the safety computer 205 (shown in FIG. 2). In the exemplary embodiment, dead man switch 309 is coupled to the mobile cart and includes a 30 foot cord. This is done because PC off-the-shelf software is not accepted as being sufficiently safe for such a critical function. Deadman switch 309 allows an operator to turn the motors on or off as required during any tilt or XY operation.

The PC based touch-screen application software is an integral part of this device and supplies several key elements, described herein below, for the ease of operation and safety of the invention.

Figure 4:
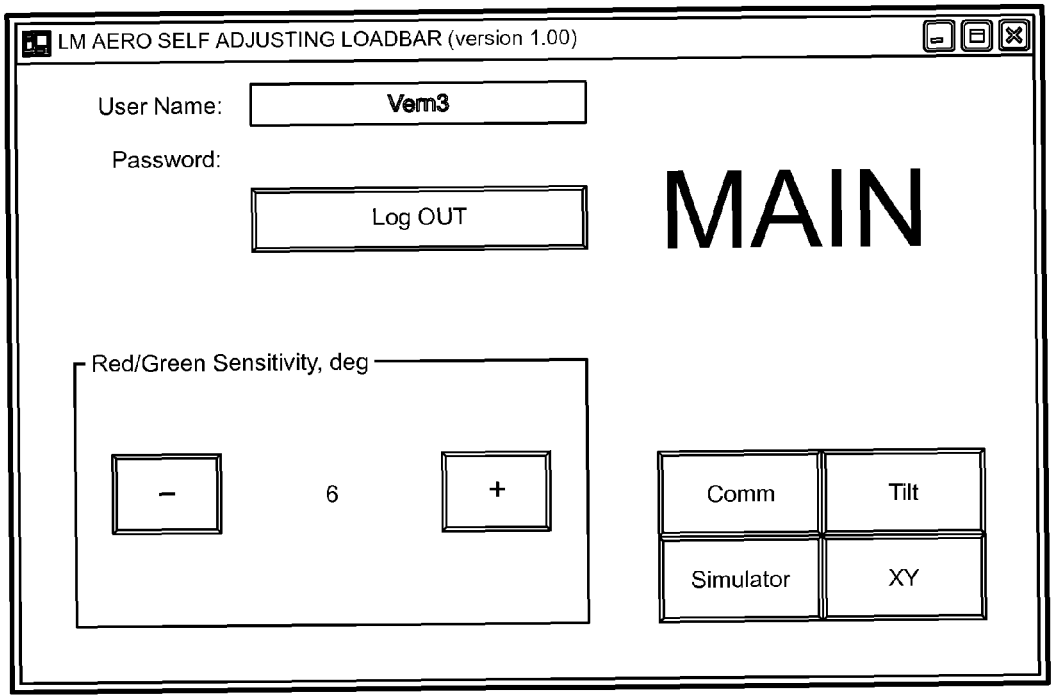
FIG. 4 is a view of a password screen that may be used with the self-adjusting load-bar show in FIG. 1.

Log-in passwords are required for operators as shown in the password screen (shown in FIG. 4). The purpose is to help ensure that the equipment is used only by personnel who have been trained properly.

The red light 221/green light 222 sensitivity setting can be adjusted on the password screen (shown in FIG. 4). When a load has to be controlled with higher angular precision, the red light/green light sensitivity can be set to a fraction of a degree. When less precision is required the sensitivity can be relaxed permitting the crane operator to lift/lower more rapidly.

Figure 5:
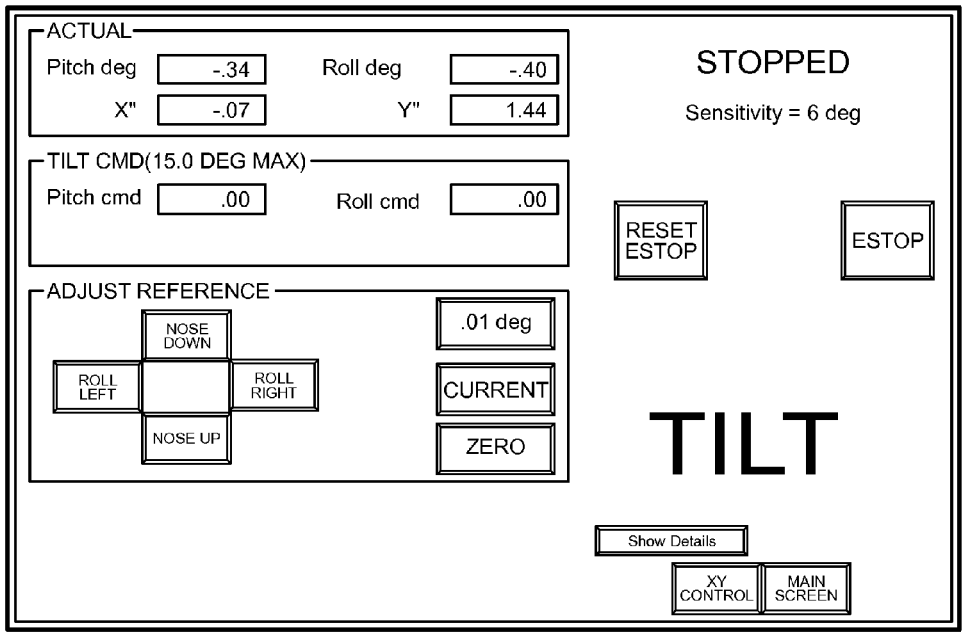
FIG. 5 is a view of a tilt screen that may be used with the self-adjusting load bar shown in FIG. 1.

The main screen for tilt operations is shown in FIG. 5 (tilt screen). This screen allows the operator to set a reference plane suitable for the load being lifted. Touch buttons make the setting operation easy. When lifting occurs, the pitch and roll tilt angle dialed in by the operator will be automatically held as long as the momentary-action deadman switch 309 is held closed. In the exemplary embodiment, users have two modes of control, tilt and XY. Specifically, tilt is shown on the tilt screen (shown in FIG. 5) and moves the motors to eliminate a deviation from a desired tilt. XY is shown on an XY screen and moves the motors to control movement of the load bar in the X and Y directions.

Figure 6:
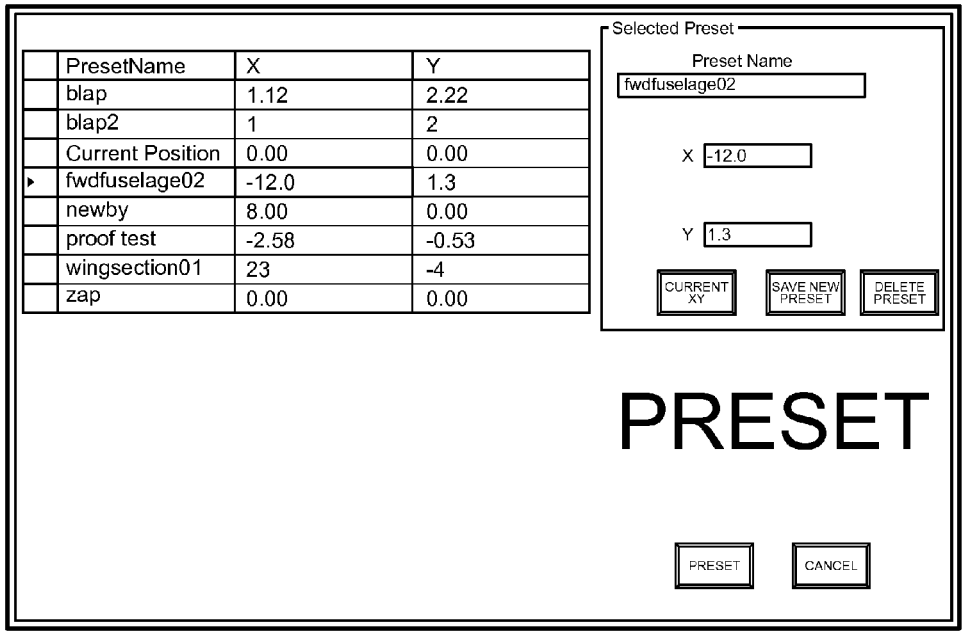
FIG. 6 is a view of a preset screen that may be used with the self-adjusting load bar shown in FIG. 1.

A learning feature is also included in the exemplary embodiment. The learning feature permits the balance coordinates in X and Y to be recorded for a load and given a name. The invention can recall these recorded settings to save time when the same component is lifted again. FIG. 6 (preset screen) is the application screen provided for this purpose.

Further, the invention includes dual acme drives. Specifically, the load bar includes two acme screws on each axis. Each screw includes a motor, an amplifier, and a computer. Since the screws cannot be back-driven, if either independent system tries to "run away" or operate erratically the system will physically lock.

In the exemplary embodiment, the invention also prevents transmission errors. Specifically, the radio transmissions have an extra level of software encoding to ensure legitimacy of transmissions. Received transmissions are interpreted by all three on-board computers, which must agree to operate.

Further, an embedded safety computer is used in the mobile cart to check the validity of messages from less reliable software. The embedded safety computer handles the safety functions of the deadman switch and E-stop.

While the invention has been described in terms of various specific embodiments, those skilled in the art will recognize that the invention can be practiced with modification within the spirit and scope of the claims.

What is claimed is:

1. A method for assembling a load bar assembly, said method comprising:

providing a first linear stage having a first alignment mechanism configured to move the load bar assembly in a first direction;

providing a second linear stage having a second alignment mechanism configured to move the load bar assembly in a second direction that is different from the first direction; and positioning the first alignment mechanism with respect to the second alignment mechanism such that the first alignment mechanism and the second alignment mechanism are prevented from being back-driven, the first alignment mechanism and the second alignment mechanism configured to be locked from further movement if a control system determines that movement of the first alignment mechanism and the second alignment mechanism is not synchronized during operation of the load bar assembly.

2. A method according to claim 1 wherein:

providing a first linear stage having a first alignment mechanism further comprises providing a first linear stage having a first alignment screw; and providing a second linear stage having a second alignment mechanism further comprises providing a second linear stage having a second alignment screw.

3. A method according to claim 1 wherein positioning the first alignment mechanism with respect to the second alignment mechanism further comprises positioning the first alignment mechanism substantially perpendicular to the second alignment mechanism.

4. A method according to claim 1 further comprising:

providing a first motor to drive the first alignment mechanism; and providing a second motor to drive the second alignment mechanism.

5. A method according to claim 1 further comprising providing at least one two-axis tilt sensor configured to detect motion of the load bar assembly.

6. A method according to claim 1 further comprising providing a deadman switch configured to control operation of the load bar assembly.

7. A frame for use with a load bar assembly, said frame comprising:

a first alignment mechanism configured to move the frame in a first direction; and a second alignment mechanism configured to move the frame in a second direction that is different from the first direction, the first alignment mechanism positioned with respect to the second alignment mechanism such that the first alignment mechanism and the second alignment mechanism are prevented from being back-driven, the first alignment mechanism and the second alignment mechanism configured to be locked from further movement if a control system determines that movement of the first alignment mechanism and the second alignment mechanism is not synchronized during operation of the load bar assembly.

8. A frame according to claim 7 wherein:

the first alignment mechanism includes a first alignment screw; and the second alignment mechanism includes a second alignment screw.

9. A frame according to claim 7 wherein the first alignment mechanism is positioned substantially perpendicular to the second alignment mechanism.

10. A frame according to claim 7 further comprising:

a first motor to drive the first alignment mechanism; and a second motor to drive the second alignment mechanism.

11. A frame according to claim 8 further comprising at least one two-axis tilt sensor configured to detect motion of the frame.

12. A frame according to claim 8 further comprising a deadman switch configured to control operation of the frame.

13. A load bar assembly comprising:

a first linear stage including a first alignment screw configured to move the load bar assembly in a first direction; and a second linear stage including a second alignment screw configured to move the load bar assembly in a second direction that is different from the first direction, wherein the first alignment screw is positioned with respect to the second alignment screw such that the first alignment screw and the second alignment screw are prevented from being back-driven, the first alignment screw and the second alignment screw configured to be locked from further movement if a control system determines that movement of the first alignment screw and the second alignment screw is not synchronized during operation of the load bar assembly.

14. A load bar assembly according to claim 13 wherein the first alignment screw is positioned substantially perpendicular to the second alignment screw.

15. A load bar assembly according to claim 13 further comprising:

a first motor to drive the first alignment screw; and a second motor to drive the second alignment screw.

16. A load bar assembly according to claim 13 further comprising at least one two-axis tilt sensor configured to detect motion of the load bar assembly.

17. A load bar assembly according to claim 13 further comprising a deadman switch configured to control operation of the load bar assembly.

* * * * *

UNITED STATES PATENT AND TRADEMARK OFFICE

CERTIFICATE OF CORRECTION

PATENT NO. : 7,931,320 B2
APPLICATION NO. : 11/947559
DATED : April 26, 2011
INVENTOR(S) : Alway et al.

It is certified that error appears in the above-identified patent and that said Letters Patent is hereby corrected as shown below:

On the title page, item (73) Assignee, delete "Innovation Engineering, Inc." and insert therefor --Innoventor Engineering, Inc.--.

Signed and Sealed this
Fourteenth Day of June, 2011

David J. Kappos

David J. Kappos
*Director of the United States Patent and Trademark Office*